US008824695B2

(12) United States Patent
Bakalos et al.

(10) Patent No.: US 8,824,695 B2
(45) Date of Patent: Sep. 2, 2014

(54) INSTABILITY DETECTION AND AVOIDANCE IN A FEEDBACK SYSTEM

(75) Inventors: Pericles Bakalos, Maynard, MA (US); Anand Parthasarathi, Ashland, MA (US)

(73) Assignee: Bose Corporation, Framingham, MA (US)

( * ) Notice: Subject to any disclaimer, the term of this patent is extended or adjusted under 35 U.S.C. 154(b) by 355 days.

(21) Appl. No.: 13/251,725

(22) Filed: Oct. 3, 2011

(65) Prior Publication Data

US 2013/0083938 A1 Apr. 4, 2013

(51) Int. Cl.

| | |
|---|---|
| ***G10K 11/16*** | (2006.01) |
| ***G10K 11/178*** | (2006.01) |
| ***H04R 3/02*** | (2006.01) |
| ***H04R 1/10*** | (2006.01) |

(52) U.S. Cl.

CPC ..... *G10K 11/1788* (2013.01); *G10K 2210/503* (2013.01); *G10K 2210/3026* (2013.01); *H04R 2460/01* (2013.01); *G10K 2210/1081* (2013.01); *H04R 3/02* (2013.01); *G10K 2210/3028* (2013.01); *H04R 1/1083* (2013.01); *H04R 2460/15* (2013.01)

USPC ..... 381/71.8

(58) Field of Classification Search

CPC ..... H04R 1/1083; G10K 15/02

USPC ..... 381/71.1–71.8, 71.11–71.14, 92

See application file for complete search history.

(56) References Cited

U.S. PATENT DOCUMENTS

| | | | | |
|---|---|---|---|---|
| 5,937,070 | A * | 8/1999 | Todter et al. | 381/71.6 |
| 7,103,188 | B1 | 9/2006 | Jones | |
| 8,229,372 | B2 * | 7/2012 | Hoyerby et al. | 455/126 |
| 2002/0003887 | A1 * | 1/2002 | Zhang et al. | 381/71.1 |
| 2010/0274564 | A1 | 10/2010 | Bakalos et al. | |
| 2011/0002474 | A1 | 1/2011 | Fuller | |
| 2011/0243344 | A1 * | 10/2011 | Bakalos et al. | 381/71.6 |
| 2013/0259251 | A1 * | 10/2013 | Bakalos | 381/71.8 |

FOREIGN PATENT DOCUMENTS

| | | |
|---|---|---|
| WO | 2010/129272 | 11/2010 |
| WO | 2010/131154 | 11/2010 |
| WO | PCT/US10/32557 | 11/2010 |

OTHER PUBLICATIONS

U.S. Appl. No. 12/766,901, Bakalos et al.
U.S. Appl. No. 12/766,902, Bakalos et al.
U.S. Appl. No. 12/766,914, Bakalos et al.
International Preliminary Report on Patentability dated Apr. 17, 2014 for International application No. PCT/US2012/057250.

* cited by examiner

*Primary Examiner* — Lun-See Lao

(57) ABSTRACT

In one aspect, in general, an active noise reduction system detects actual or potential instability by detecting characteristics of the system related to potential or actual unstable behavior (e.g., oscillation) and adapts system characteristics to mitigate such instability. In some examples, the system adapts to variation in characteristics of an acoustic component of a feedback path that has or may induce unstable behavior to improve a user's acoustic experience.

24 Claims, 16 Drawing Sheets

202

1100

Blocked Tip Detector State Table

| PD | OD | ZD | BT | CASE |
|---|---|---|---|---|
| 0 | 0 | 0 | 0 | STABLE |
| 0 | 0 | 1 | X | DON'T CARE |
| 0 | 1 | 1 | X | DON'T CARE |
| 0 | 1 | 0 | 1 | UNSTABLE |
| 1 | 1 | 0 | 0 | STABLE (FALSE TRIGGER DUE TO OCCLUSION) |
| 1 | 1 | 1 | 1 | UNSTABLE |
| 1 | 0 | 1 | 1 | UNSTABLE |
| 1 | 0 | 0 | 0 | STABLE |

BT = Blocked Tip / Instability Detected, Active High

BT = ZD + (/PD)(OD)

FIG. 12

INSTABILITY DETECTION AND AVOIDANCE IN A FEEDBACK SYSTEM

BACKGROUND

This invention relates to instability detection and avoidance in a feedback system, in particular in a feedback active noise reduction system.

The presence of ambient acoustic noise in an environment can have a wide range of effects on human hearing. Some examples of ambient noise, such as engine noise in the cabin of a jet airliner, can cause minor annoyance to a passenger. Other examples of ambient noise, such as a jackhammer on a construction site can cause permanent hearing loss. Techniques for the reduction of ambient acoustic noise are an active area of research, providing benefits such as more pleasurable hearing experiences and avoidance of hearing losses.

Many conventional noise reduction systems utilize active noise reduction techniques to reduce the amount of noise that is perceived by a user. Active noise reduction systems are commonly implemented using feed-forward, feedback, or a combination of feed-forward and feedback approaches. Feedback based systems typically measure a noise sound wave, possibly combined with other sound waves, near an area where noise reduction is desired (e.g., in an acoustic cavity such as an ear cavity). In general, the measured signals are used to generate an "anti-noise signal" which is a phase inverted and scaled version of the measured noise. The anti-noise signal is provided to a noise cancellation driver which transduces the signal into a sound wave which is presented to the user. When the anti-noise sound wave produced by the noise cancellation driver combines in the acoustic cavity with the noise sound wave, the two sound waves cancel one another due to destructive interference. The result is a reduction in the noise level perceived by the user in the area where noise reduction is desired.

Feedback systems generally have the potential of being unstable and producing instability based distortion. For example, as understood based on classical analysis of feedback systems, if the gain of a feedback loop is greater than 1 at a frequency where the phase of the feedback loop is 180°, oscillatory additive signals can be generated at that frequency. Such a situation can also be described as the phase margin, which is the margin to reach 180° phase at a frequency at which the gain is 1, of the system being zero or negative.

In an acoustic active noise reduction system, at least a part of the feedback path can include an acoustic component. Although electrical or digital components of the feedback path can be directly controlled in an active noise reduction system, the acoustic component may be subject to variation, for example, as a result of variation in the physical characteristics of the acoustic path.

SUMMARY

In some cases, variation in the acoustic path may result in instability in the system due to resulting variation in the feedback loop gain or transfer function. For example, the acoustic component can have an acoustic transfer function between an acoustic driver and a feedback microphone. One example of a situation where the acoustic transfer function varies is when a wearer of an in-ear headphone inserts the earbud of the headphone into the ear canal. During the insertion process, the compliant tip of the earbud can become blocked, for example, by being pinched or folded over itself.

Such a blocked tip can alter the acoustic transfer function, thereby altering the overall loop gain and potentially causing instability in the system.

There is a need for a system which can detect characteristics of instability in a feedback noise reduction system and adjust the loop gain of the system to avoid instability.

In one aspect, in general, an active noise reduction system detects actual or potential instability by detecting characteristics of the system related to potential or actual unstable behavior (e.g., oscillation) and adapts system characteristics to mitigate such instability.

In some examples, the system adapts to variation in characteristics of an acoustic component of a feedback path that has or may induce unstable behavior to improve a user's acoustic experience.

In an aspect, in general, a feedback based active noise reduction system includes a feedback element and an instability detector for detecting an instability condition in the feedback element and forming the control parameter based on a result of the detection. The feedback element includes a feedback input for accepting a first feedback signal from a first sensor, a control input for accepting a control parameter for adjusting a gain characteristic and a phase characteristic of the feedback element, and a driver output for providing a driver signal to a driver. The instability detector includes a control parameter output for providing the control parameter to the control parameter input of the feedback element, and a plurality of inputs for accepting a plurality of feedback signals from a plurality of sensors including the first sensor. Detecting the instability condition includes processing the plurality of feedback signals to determine a characteristic of an acoustic path between the driver and the first sensor.

Aspects may include one or more of the following features.

The first sensor may include a microphone and the driver may include a loudspeaker. The feedback element may be configured to cause one or both of the gain characteristic and the phase characteristic of the feedback element to change by a predetermined amount upon providing of the control parameter. The feedback element may be configured to concurrently modify a transfer function of a feedback filter, a feedforward filter, and an audio input filter upon providing of the control parameter.

The feedback element may be configured to cause the bandwidth of the feedback element to change by a predetermined amount upon providing of the control parameter. The feedback element may include a low-pass filter selectably applicable to the feedback element according to the control parameter. The plurality of sensors may include a second sensor and the instability detector may be configured to determine the characteristic of the acoustic path between the driver and the first sensor based on a ratio of the first feedback signal associated with the first sensor to a second feedback signal associated with the second sensor.

The ratio of the first feedback signal to the second feedback signal may represent an acoustic impedance of the acoustic path. The first sensor may include a pressure microphone and the second sensor may include a velocity microphone. The first sensor may include a pressure microphone and the second sensor may include a pressure microphone. The plurality of sensors may include a third sensor for producing a third feedback signal and the instability detector may be configured to determine the validity of the instability condition detected by the instability detector based on the third feedback signal.

The feedback element may include a first signal input for accepting an input signal, the instability detector may include a second signal input for accepting the input signal and a driver input for accepting the driver signal, and the instability detector may be configured to detect the instability condition in the feedback element including determining a characteristic of the feedback element based on the input signal and the driver signal. The instability condition may include the presence of an oscillation in a specified frequency range. The specified frequency range may be mutually exclusive from a frequency range where active noise reduction occurs.

The instability detector may be configured to analyze the input signal and driver signal to determine whether the oscillation is present in the driver signal and that the oscillation is not present in the input signal In another aspect, in general, a method for detecting and avoiding instability in a feedback based active noise reduction system includes detecting an instability condition in a feedback element and forming a control parameter based on the result of the detection. Detecting the instability condition includes accepting a plurality of feedback signals from a plurality of sensors including a first sensor, and processing the plurality of feedback signals to determine a characteristic of an acoustic path between the driver and the first sensor. The method also includes providing the control parameter to the feedback element, accepting, at the feedback element, the control parameter, accepting, at the feedback element, a first feedback signal from the first sensor, adjusting a gain characteristic and a phase characteristic of the feedback element based on the control parameter, and outputting, from the feedback element, a driver output signal to a driver.

Aspects may include one or more of the following features.

The first sensor may include a microphone and the driver may include a loudspeaker. Providing the control parameter to the feedback element may cause one or both of the gain characteristic and the phase characteristic of the feedback element to change by a predetermined amount. Providing the control parameter to the feedback element may cause a concurrent modification of a transfer function of a feedback filter, a feedforward filter, and an audio input filter. Providing the control parameter to the feedback element may cause the bandwidth of the feedback element to change by a predetermined amount. Providing the control parameter to the feedback element may cause a low-pass filter to be selectably applied to the feedback element based on the provided parameter.

The plurality of sensors may include a second sensor and determining the characteristic of the acoustic path between the driver and the first sensor may include calculating a ratio of the first feedback signal associated with the first sensor to a second feedback signal associated with the second sensor. The ratio of the first feedback signal to the second feedback signal may represent an acoustic impedance of the acoustic path. The first sensor may include a pressure microphone and the second sensor may include a velocity microphone.

The first sensor may include a pressure microphone and the second sensor may include a pressure microphone. The plurality of sensors may include a third sensor for producing a third feedback signal and detecting the instability condition may include determining the validity of the instability condition based on the third feedback signal.

The method may also include the steps of accepting, at the feedback element, an input signal, wherein detecting the instability condition further includes accepting the input signal, accepting the driver signal, and determining a characteristic of the feedback element based on the input signal and the driver signal.

The instability condition may include the presence of an oscillation in a specified frequency range. The specified frequency range may be mutually exclusive from a frequency range where active noise reduction occurs. Detecting the instability condition may include analyzing the input signal and driver signal to determine whether the oscillation is present in the driver signal and that the oscillation is not present in the input signal.

Embodiments may have one or more of the following advantages.

Embodiments may require few electronic parts, resulting in a reduced cost relative to conventional systems which include general purpose digital signal processing (DSP) hardware.

Embodiments may consume very little power (e.g., microwatts) since they do not require high speed/low noise operational amplifiers.

Embodiments may react to disturbances more quickly than DSP based systems which require long measurement and calculation times. In some examples DSP based systems do not react quickly enough to prevent a loud, high pitched sound from impinging on the eardrum for an extended duration due to the close proximity of the loudspeaker driver to the eardrum in a headphone device.

Embodiments are immune to being triggered by audio signals alone, and can reliably detect oscillation in the presence of audio signals.

Other features and advantages of the invention are apparent from the following description, and from the claims.

DESCRIPTION OF DRAWINGS

FIG. 12 is a truth table showing the logic used to compute the output of the combined oscillation/blocked tip detector.

DESCRIPTION

1. Overview

The system described herein detects actual or potential feedback loop instability due to excessive feedback loop gain in a feedback control based active noise reduction system and mitigates the instability to return the system to a stable or more stable operating state.

The system leverages the knowledge that:

a) as the gain of the feedback loop approaches 1 at a frequency where the phase of the feedback loop approaches 180°, the bandwidth of the gain of the feedback loop increases. This reduces the phase margin in the system, ultimately resulting in an unstable feedback loop which can result in oscillation or damped oscillation at that frequency.

b) when the tip of an earbud is obstructed, a significant change in acoustic impedance occurs, altering the feedback loop gain.

Upon detection of instability in the feedback loop, the system mitigates the instability by adjusting the gain of the feedback loop.

2. Oscillation Detector

Figure 1:
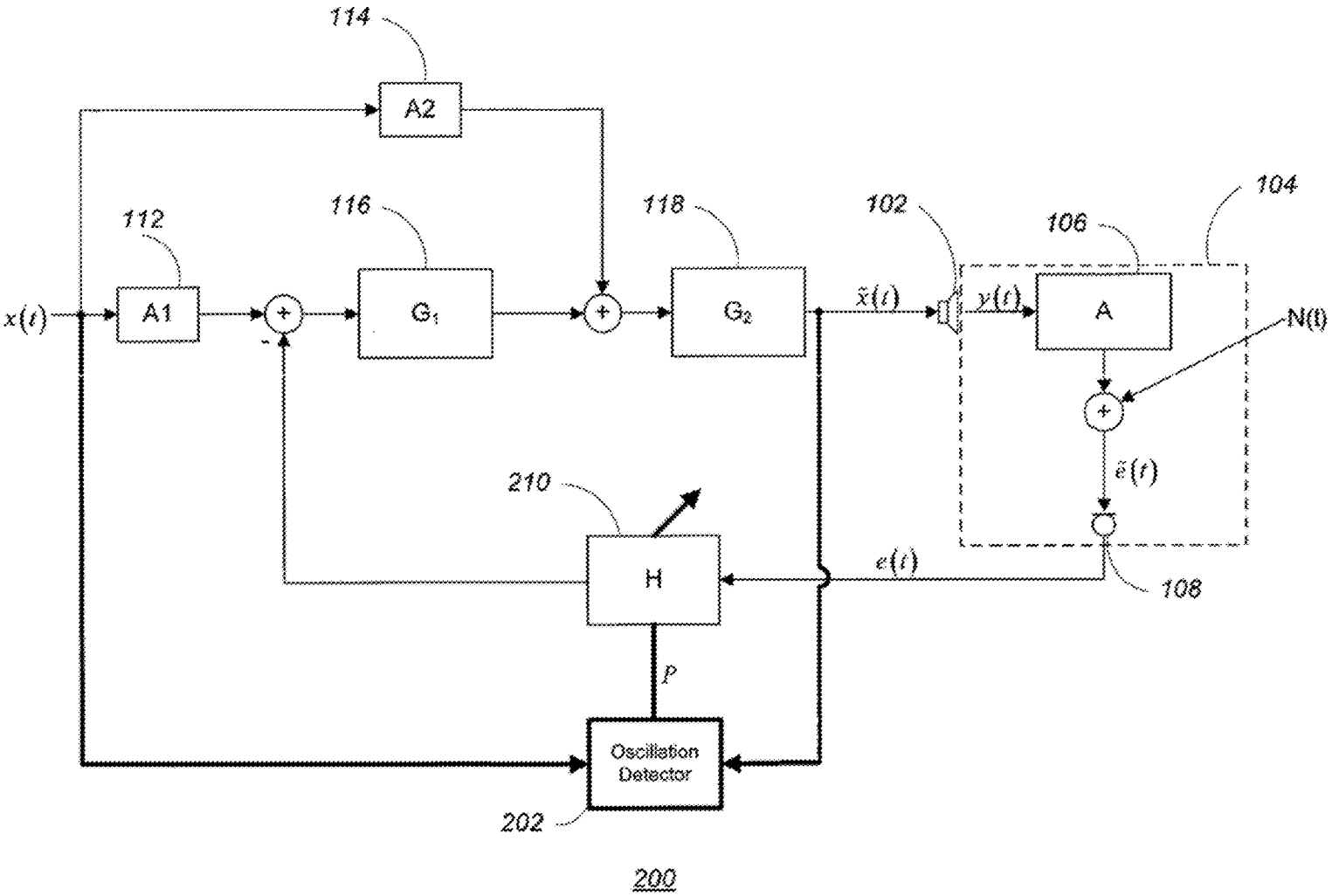
FIG. 1 is a block diagram of a feedback noise reduction system including an oscillation detector.

Referring to FIG. 1, a system for acoustic active noise reduction 200 receives an input signal (e.g., an audio signal), x(t) and provides a modified version of the input signal, to an acoustic driver 102. The acoustic driver 102 transduces the modified version of the input signal into a sound wave, y(t), in an acoustic cavity 104. In the acoustic cavity 104, y(t) passes through an acoustic transfer function, A 106, between the acoustic driver 102 and a feedback microphone 108. The result of y(t) passing through A 106, combines with a noise sound wave, N(t), to produce ẽ(t). The feedback microphone 108 measures ẽ(t), transducing the sound wave into an electrical signal, e(t). This signal is passed along a feedback path, through a feedback factor, H 210.

In a forward path, the input signal, x(t) is provided to a first transfer function block, $A_1$ 112. The output of the feedback factor H 210 is then subtracted from the output of the first transfer function block 112. In some examples, the output of $A_1$ 112 includes only (or predominantly) the frequency components of x(t) that are within a desired active noise reduction bandwidth, with the frequencies that are outside the desired active noise reduction bandwidth attenuated. The result of the subtraction is provided to first forward path gain element, $G_1$ 116.

In parallel, the input signal, x(t), is provided to a second transfer function block, $A_2$ 114. The output of the first forward path gain element $G_1$ 116 is added to the output of the second transfer function block 114. In some examples, the output of $A_2$ 114 includes only the frequency components of x(t) that are outside the desired active noise reduction bandwidth, with the frequencies that are within the desired active noise reduction bandwidth attenuated. The result of the addition is provided to a second forward path gain element, $G_2$ 118. The output of the second forward path element $G_2$ 118 is provided to the acoustic driver 102.

In some examples, the purpose of injecting different components of the input signal, x(t) into the forward path at different stages is to apply higher gain to components of the input signal which are deemed as more important. For example, the system of FIG. 1 injects the frequency components of x(t) that are within the active noise reduction bandwidth earlier in the system than those frequency components of x(t) that are outside of the active noise reduction bandwidth. This results in the application of more gain (i.e., both $G_1$ 116 and $G_2$ 118) to the frequency components that are within the active noise reduction bandwidth and the application of less gain (i.e., only $G_2$ 118) to the frequency components that are outside the active noise reduction bandwidth. Higher feedback gain results in greater noise reduction.

In some examples, x(t)=0 (i.e., no input signal is provided). In such examples, the active noise reduction system reduces ambient noise at the feedback microphone, driving the signal sensed at the microphone to zero.

In the system shown in FIG. 1, e(t) is a measurement of the acoustic signal in the acoustic cavity at the location of the feedback microphone 108. In the frequency domain, e(t) can be expressed as E(ω) as follows:

$$E(\omega) = \frac{G_1G_2A_1X(\omega) + G_2A_2AX(\omega) + N(\omega)}{1 + G_1G_2HA}$$

The $G_1G_2HA$ term in the denominator is commonly referred to as the feedback loop gain. It is noted that while this term is referred to herein as the "loop gain", the term should be understood as a loop characteristic, including both a frequency dependent gain response of the feedback loop and a frequency dependent phase response of the feedback loop. Thus, a statement such as: "the loop gain equals 1<180° " should be understood as a loop characteristic where the loop gain at a frequency is equal to 1 and the loop phase is equal to 180°.

By inspection, one can see that as the gain of the first and second forward path gain elements 116, 118 becomes very large, the noise term, N(ω) is reduced. In this way, noise reduction in the system of FIG. 1 is accomplished using a high loop gain.

Also note that as the first and second forward path gain elements 116, 118 become very large, the $G_1G_2A_1X(\omega)$ term is less affected by the high loop gain than the $G_2A_2AX(\omega)$ term as is expected due to the two injection points of the input signal, x(t).

Referring to the portions of FIG. 1 shown in bolded lines, the system includes an oscillation detector 202 that is configured to detect oscillations at the frequency where the loop gain equals 1<180°. If an oscillation is detected, the oscillation detector 202 can trigger a loop gain adjustment to return the feedback loop to a stable operating state.

The oscillation detector 202 receives the input signal x(t) and the output of the second forward path gain element 118, x̃(t) and outputs a control parameter, P to the adjustable feedback factor, H 210. The control parameter, P indicates whether oscillations that are due to instability are present in the feedback loop and commands the feedback factor, H 210 (e.g., by outputting P=HIGH) to adjust the loop gain if necessary.

Figure 2:
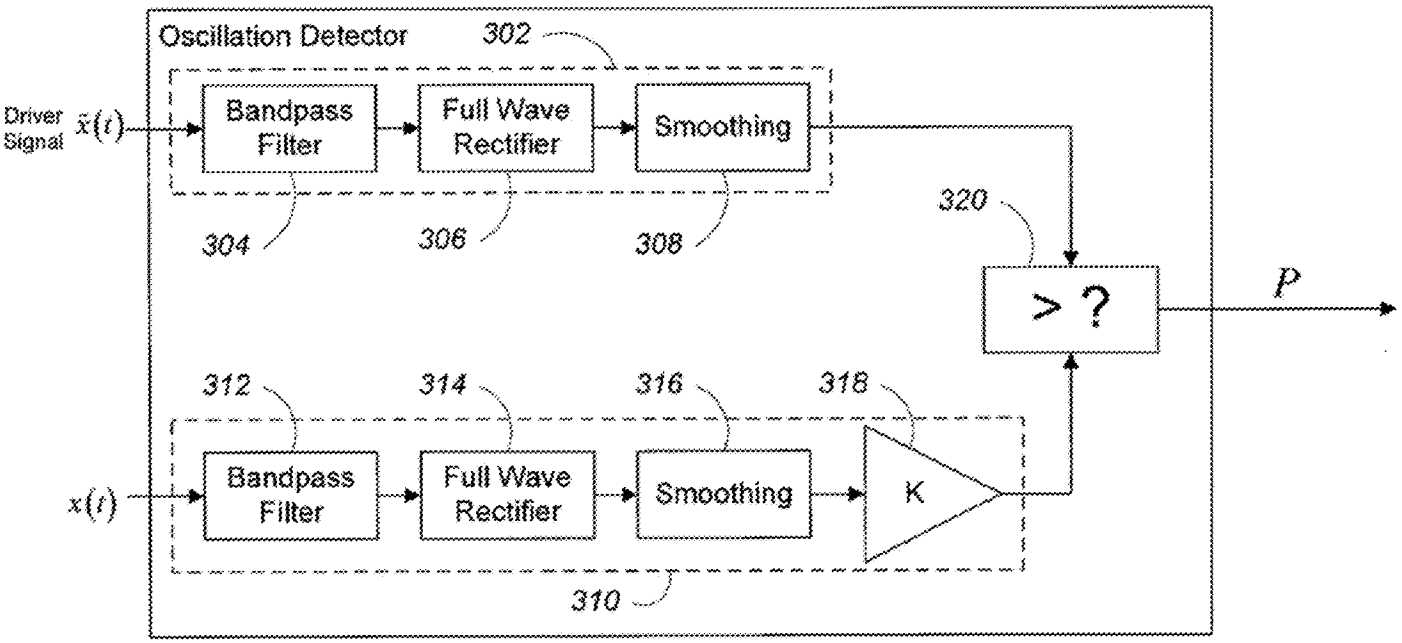
FIG. 2 is an oscillation detector.

Referring to FIG. 2, the oscillation detector 202 processes x̃(t) and x(t) and compares the resulting processed signals to determine if oscillations are present in the feedback loop that are not present in the input signal. The processing of the signals is based on the knowledge that an oscillation signal due to feedback loop instability typically occurs in a frequency range where the loop gain is near 1<180°. Furthermore, it is typical that active noise reduction signals are present at lower frequencies than the oscillation signal.

The oscillation detector 202 processes x̃(t) and x(t) in two separate paths. A driver signal path 302 applies a band-pass filter 304 to x̃(t), the band-pass filter 304 having a pass-band at the frequency range where oscillation due to instability is expected. The filtered output of the band-pass filter 304 is rectified by a full wave rectifier 306 and smoothed by a smoothing element 308 (e.g., a low pass filter). The result of the driver signal path 302 is a signal level of x̃(t) in the frequency range where oscillation due to instability is expected.

In the absence of the input signal, x(t), (i.e., when no audio driving signal is provided) the driver signal path 302 is sufficient for detecting oscillations due to instability in the feedback loop. However, in the presence of the input signal, x(t) it is necessary to process both x(t) and x̃(t). This is due to the fact that the input signal x(t) (e.g., an audio signal), may include frequency components which are present in the frequency range where oscillation is expected. In the presence of such an input signal, false instability detection results may occur.

Thus, to improve the robustness of the system, x(t) is processed in a reference signal path 310 for the purpose of establishing a dynamic threshold reference. The reference signal path applies a band-pass filter 312 to x(t), the band-pass filter 312 having a pass band at the frequency range where oscillation due to instability is expected. The filtered output of the band-pass filter 312 is rectified by a full wave rectifier 314 and smoothed by a smoothing element 316 (e.g., a low pass filter).

The output of the smoothing element 316 is a signal level of x(t) in the frequency range where oscillation due to instability is expected. This output is scaled by a scale factor, K 318, such that the output of the reference signal path 310 is slightly greater than the output of the driver signal path 302 when x(t) is present and no oscillation is present in the feedback loop.

The output of the driver signal path 302 and the output of the reference signal path 310 are provided to a differential detector 320 which outputs a value of P=HIGH if the output of the driver signal path 302 is greater than the output of the reference signal path 310 (i.e., oscillation is present) and a P=LOW if the output of the driver signal path 302 is less than the output of the reference signal path 310 (i.e., no oscillation is present).

3. Adjustable Feedback Factor

Parameter P (e.g., a HIGH or LOW output) output by the oscillation detector 202 is provided to the adjustable feedback factor, H (FIG. 1, element 210). In some examples, the adjustable feedback factor 210 is adjusted, based on the parameter P to modify the overall feedback loop gain of the system across all or a wide range of frequencies. In other examples, the adjustable feedback factor 210 is adjusted, based on the parameter P to modify the bandwidth of the feedback loop gain, for example by reducing the gain over a limited range of frequencies. In some examples, the modification of the feedback loop gain is maintained for a predetermined amount of time. After the predetermined amount of time (e.g., 3 seconds) has elapsed, the modification of the feedback loop gain is reversed.

3.1 Overall Gain Adjustment

Figure 3:
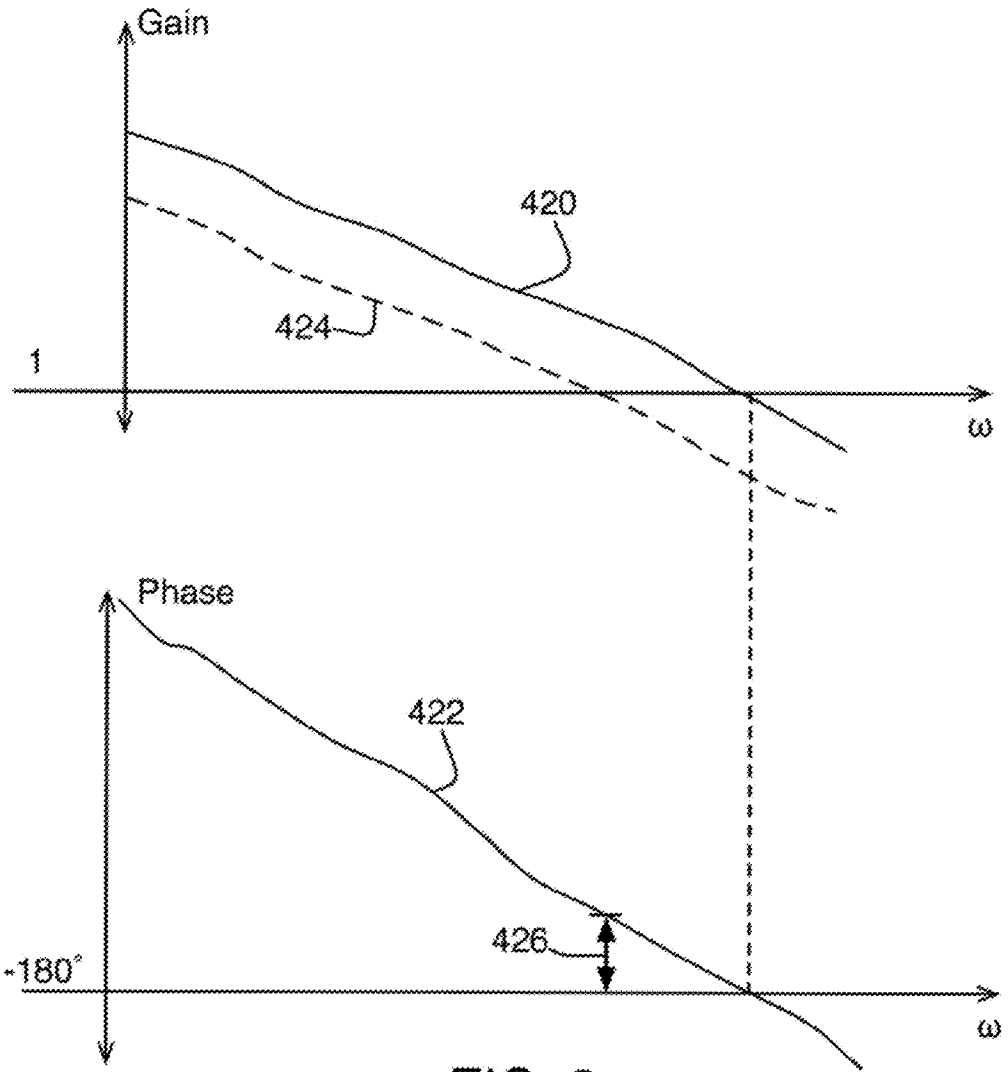
FIG. 3 is a graph showing gain and phase margin.

Referring to FIG. 3, an example of a feedback loop gain and phase response illustrates an unstable situation in the feedback loop of the system of FIG. 1. In particular, the feedback loop is in an unstable situation due to the solid gain curve 420 being equal to 1 and the solid phase curve 422 being equal to 180° at the frequency. In this situation, the phase margin is 0°, causing instability.

In some examples, the adjustable feedback factor 210 is configurable to mitigate this instability by reducing the gain by a predetermined amount based on the parameter P received from the instability detector 202. In particular, if P indicates that the phase margin is at or near 0° (i.e., the instability detector outputs a HIGH parameter value), the feedback factor reduces the overall gain by a predetermined amount.

The dashed gain curve 424 is the result of an overall reduction of the feedback loop gain. Since the phase curve 422 is not changed, reducing the overall loop gain results in an increased phase margin 426, returning the feedback loop to a stable operating state.

Figure 4:
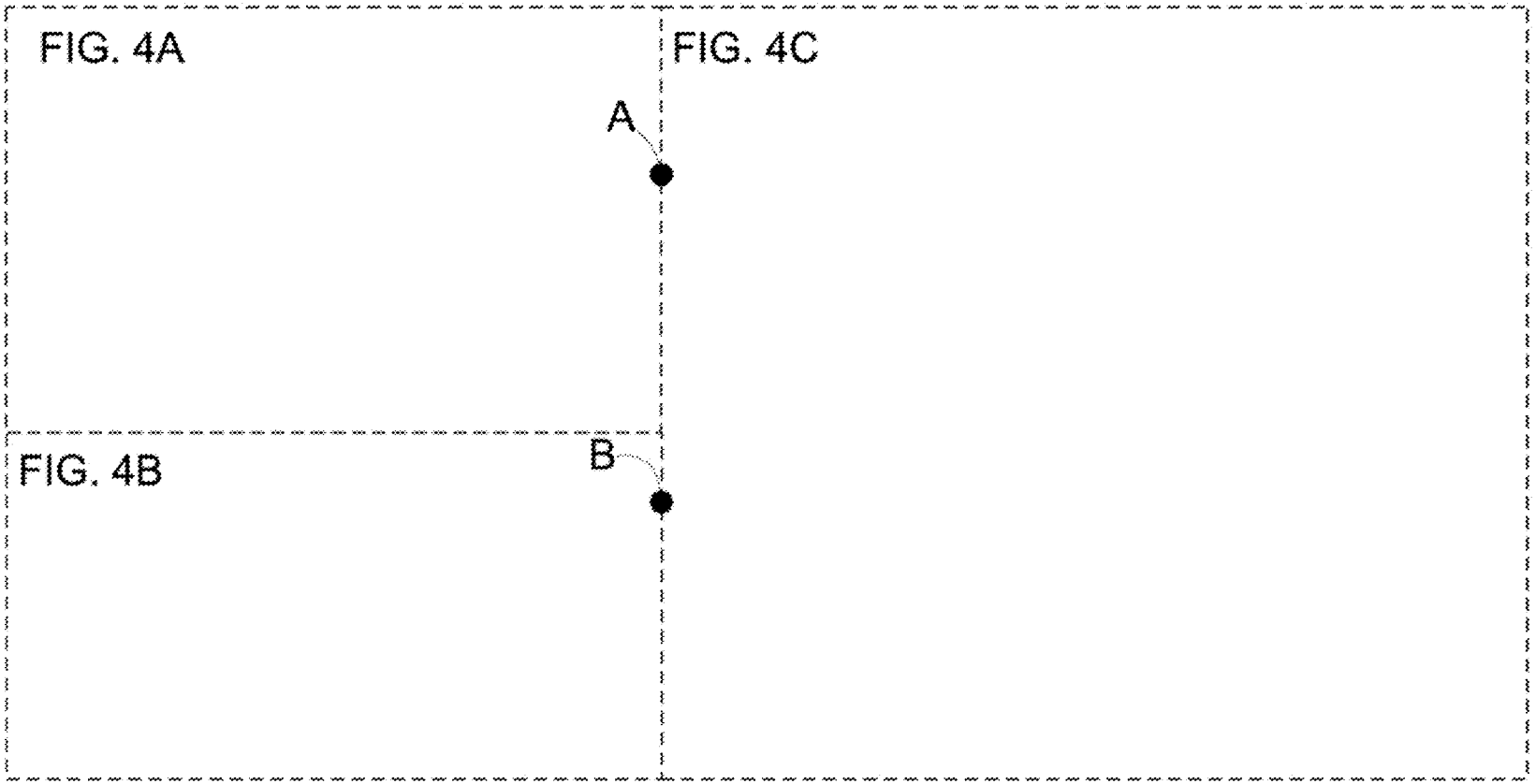
FIG. 4 is a circuit configured to reduce loop gain.
Figure 4A:
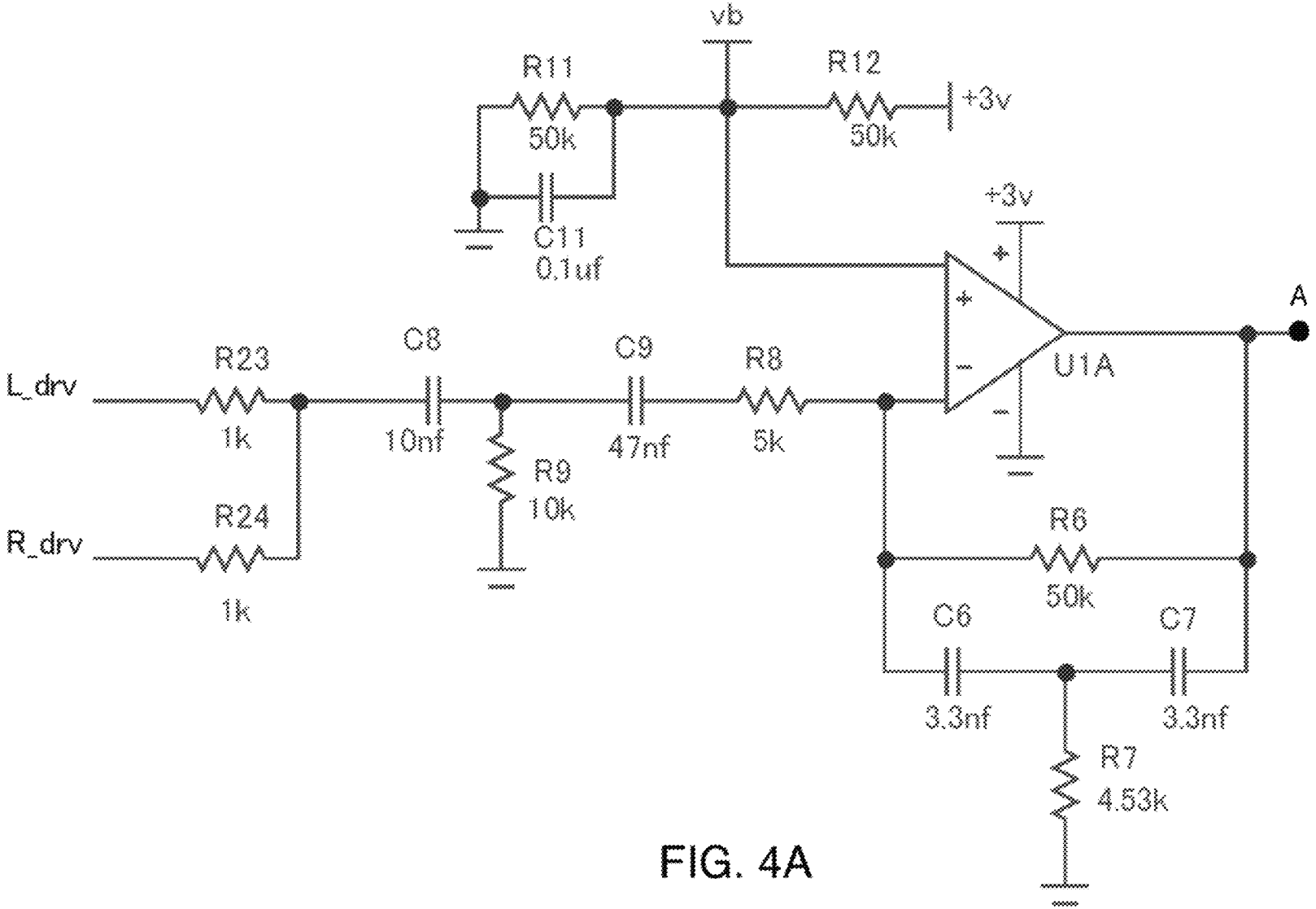
Figure 4B:
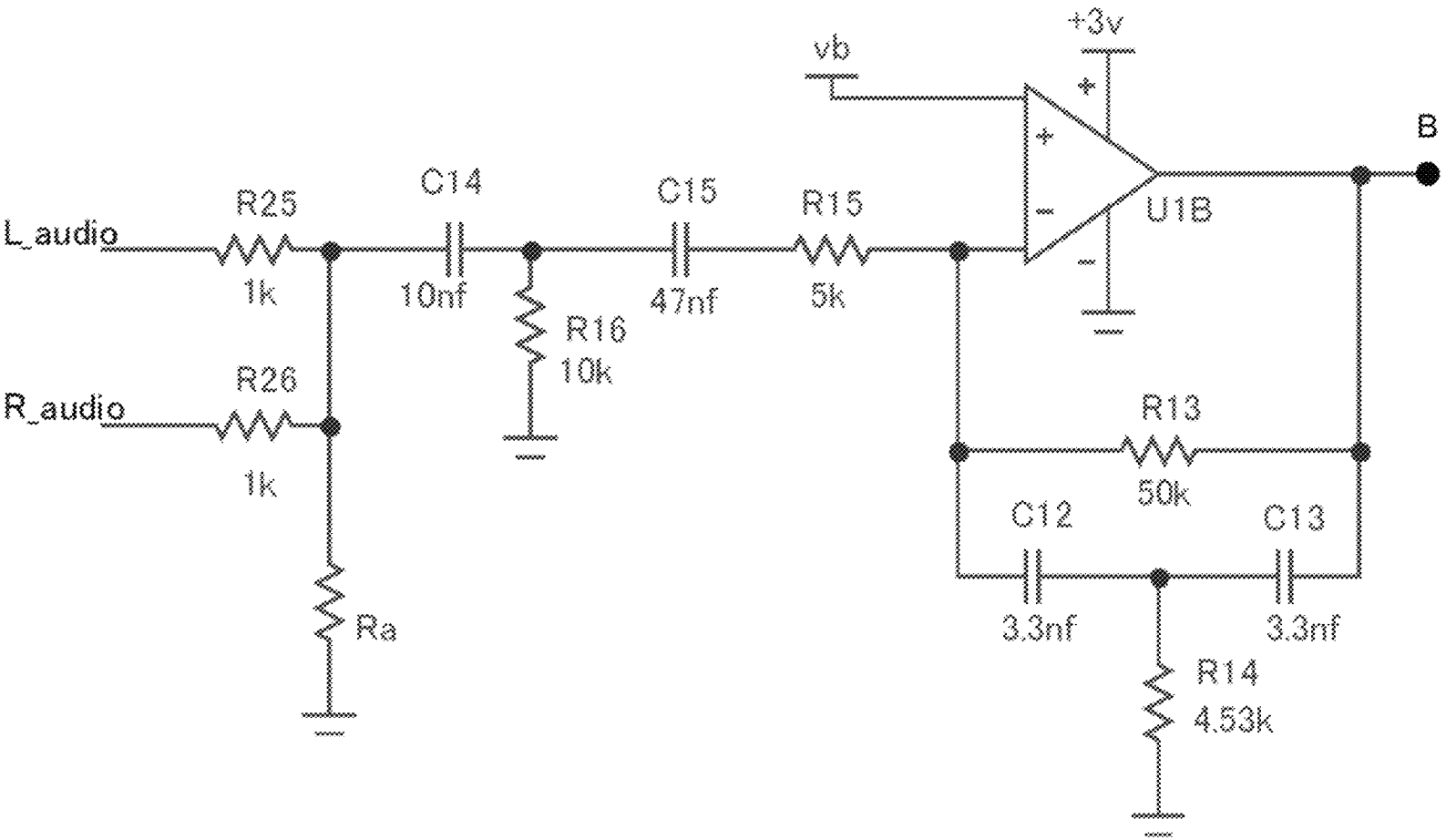
Figure 4C:
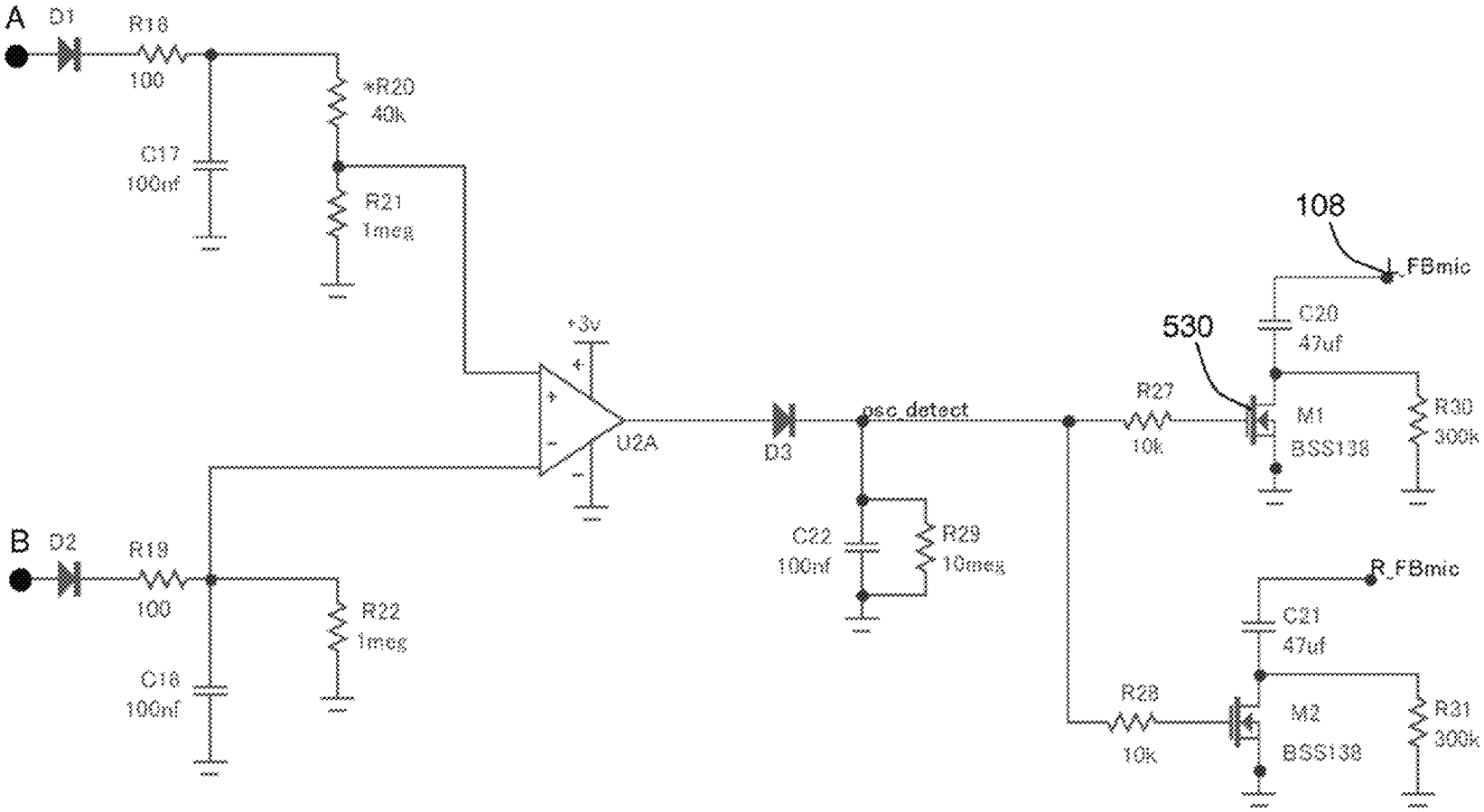

Referring to FIG. 4, a circuit is configured to reduce the overall loop gain passed on P. The overall reduction in loop gain is achieved by a P=HIGH output from the instability detector 202 turning on a mosfet 530 at the feedback microphone 108, thereby reducing the loop gain at the feedback microphone input 108.

3.2 Bandwidth Adjustment

Figure 5:
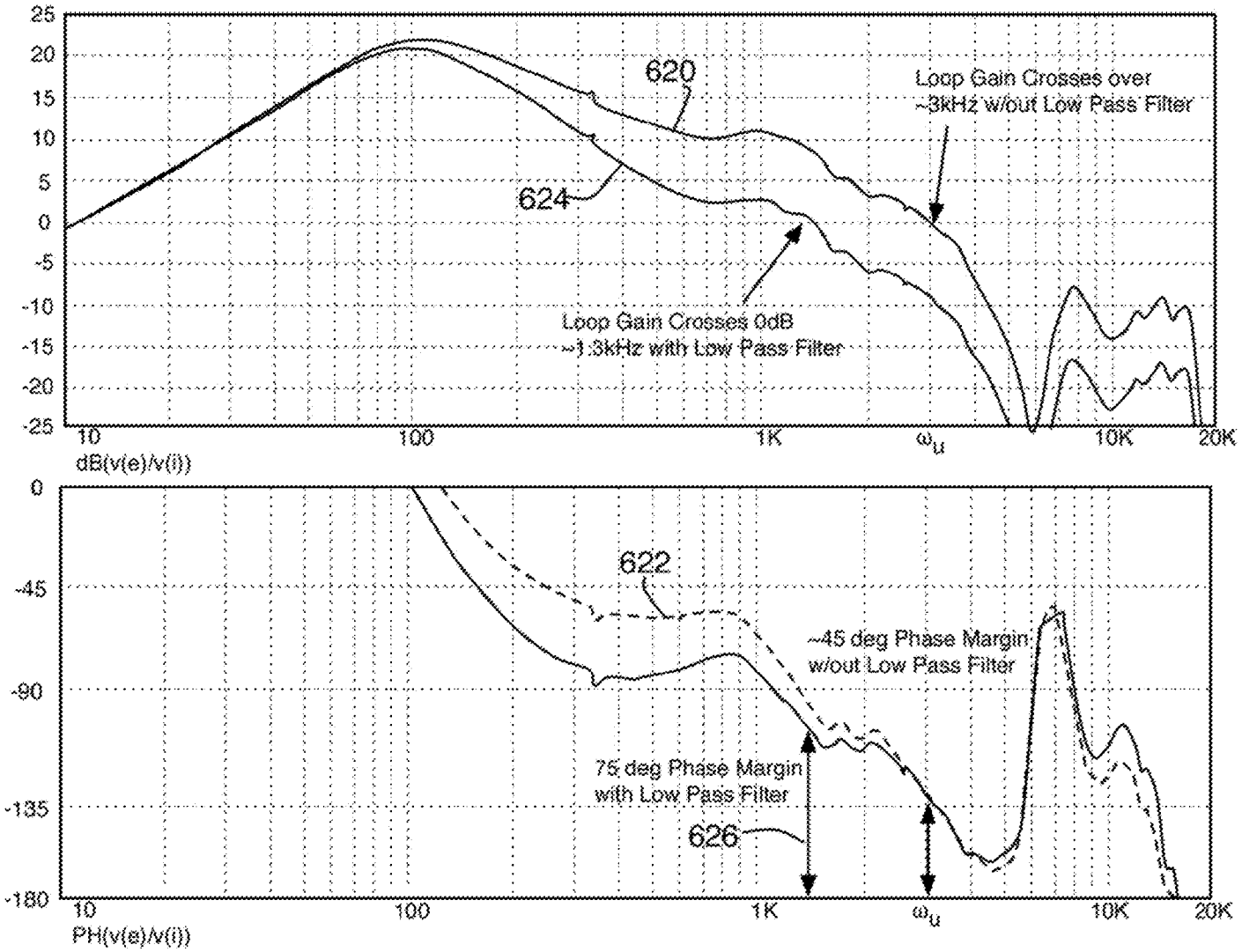
FIG. 5 is a graph showing gain and phase margin.

Referring to FIG. 5, another example of a feedback loop gain and phase response illustrates an unstable situation in the feedback loop of the system of FIG. 1. In particular, the feedback loop is in an unstable situation due to a first gain curve 620 having a value of 0 dB at a frequency, $\omega_u$, where a first phase curve 622 has a value close to −180°. In this situation, the phase margin is reduced, causing instability.

In some examples, the adjustable feedback factor 210 is configurable to switch the feedback loop gain between a high bandwidth mode and a low bandwidth mode based on the parameter P. The high bandwidth mode is used during normal operation of the system and the low bandwidth mode is used when a system change places the system in a potentially unstable operating state. If the parameter, P indicates that the bandwidth of the feedback loop needs to be reduced (i.e., the instability detector outputs a P=HIGH parameter value), the adjustable feedback factor enables a low-pass filtering operation in the feedback path.

A second loop gain curve 624 shows a reduction in the loop gain at high frequencies with little effect on the loop gain at low frequencies. Such a reduction in the bandwidth of the loop gain results in an increased the phase margin 626 while having less impact on the audio output quality of the system when compared to the previously described overall reduction in loop gain.

Figure 6:
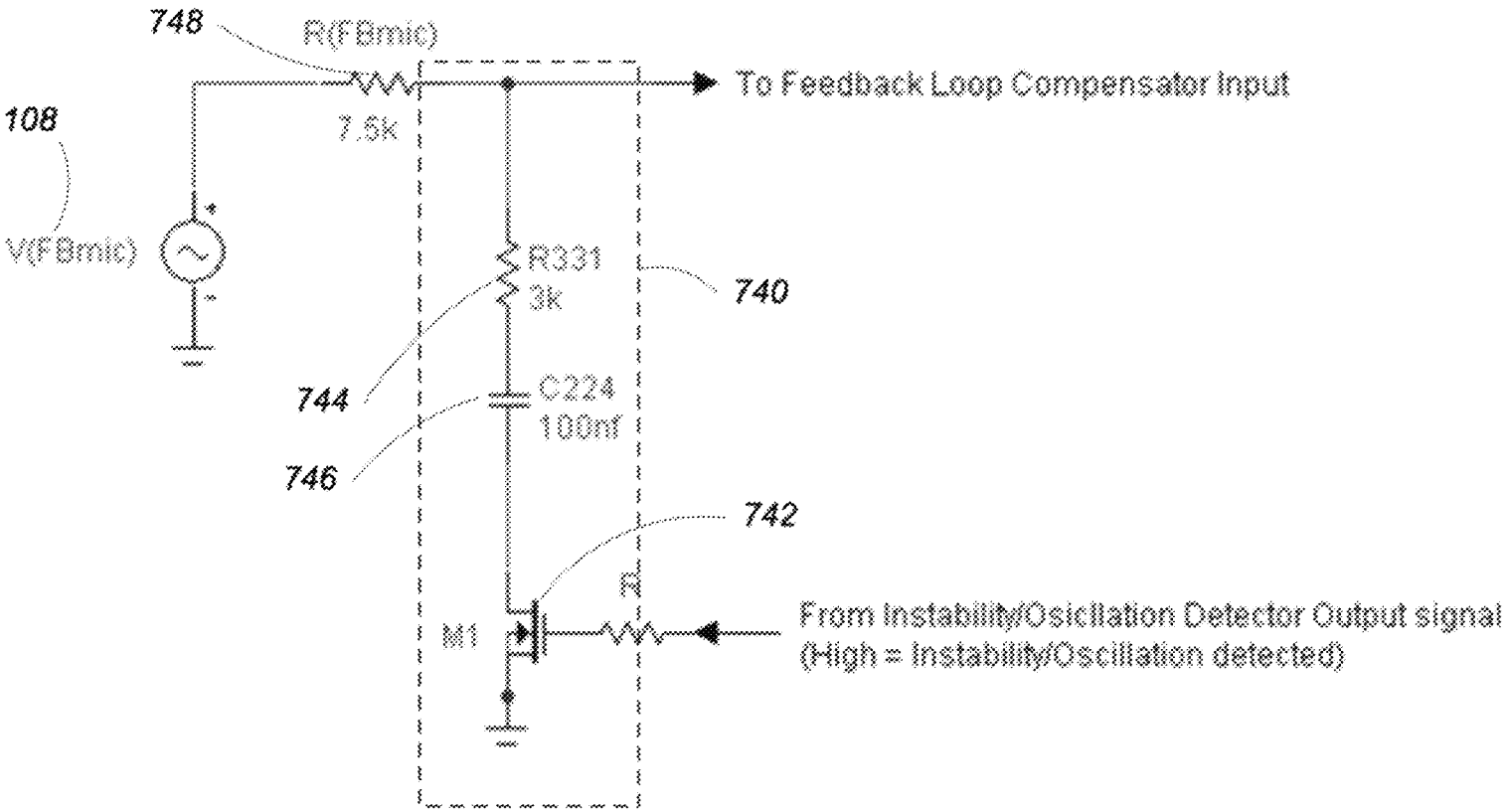
FIG. 6 is a circuit configured to reduce loop gain and bandwidth.

Referring to FIG. 6, one example of the adjustable feedback factor 210 achieves the low bandwidth mode of the feedback loop gain by switching in a simple pole-zero low pass network 740 into the existing high bandwidth feedback loop upon detection of a potentially unstable operating state.

For example, the parameter output, P of the instability detector (FIG. 1, element 202) can be provided to mosfet, M1 742 such that a HIGH parameter value switches M1 742 to an on state. When M1 742 is on, an RC network 744, 746 is switched into the system. The RC network 744, 746, along with the effective output impedance 748 of the feedback microphone 108 forms a low-pass filter.

The low-pass filter formed by the RC network 744, 746 and the effective impedance 748 of the feedback microphone 108 includes a zero break (caused by the inclusion of resistor R331 744). The zero break halts phase lag in the low-pass filter at higher frequencies, resulting in a higher stability margin.

The adjustable feedback factor 210 described above can be implemented using analog or digital electronics. In some examples, the parameter output P of the instability detector 202 is used to switch a compensation filter with a different transfer function than those described above into the system. In some examples a different compensation filter is used based on whether the adjustable feedback factor is implemented using analog electronics or digital electronics (e.g., dedicated DSP hardware).

4. Blocked Tip Detection

Figure 7:
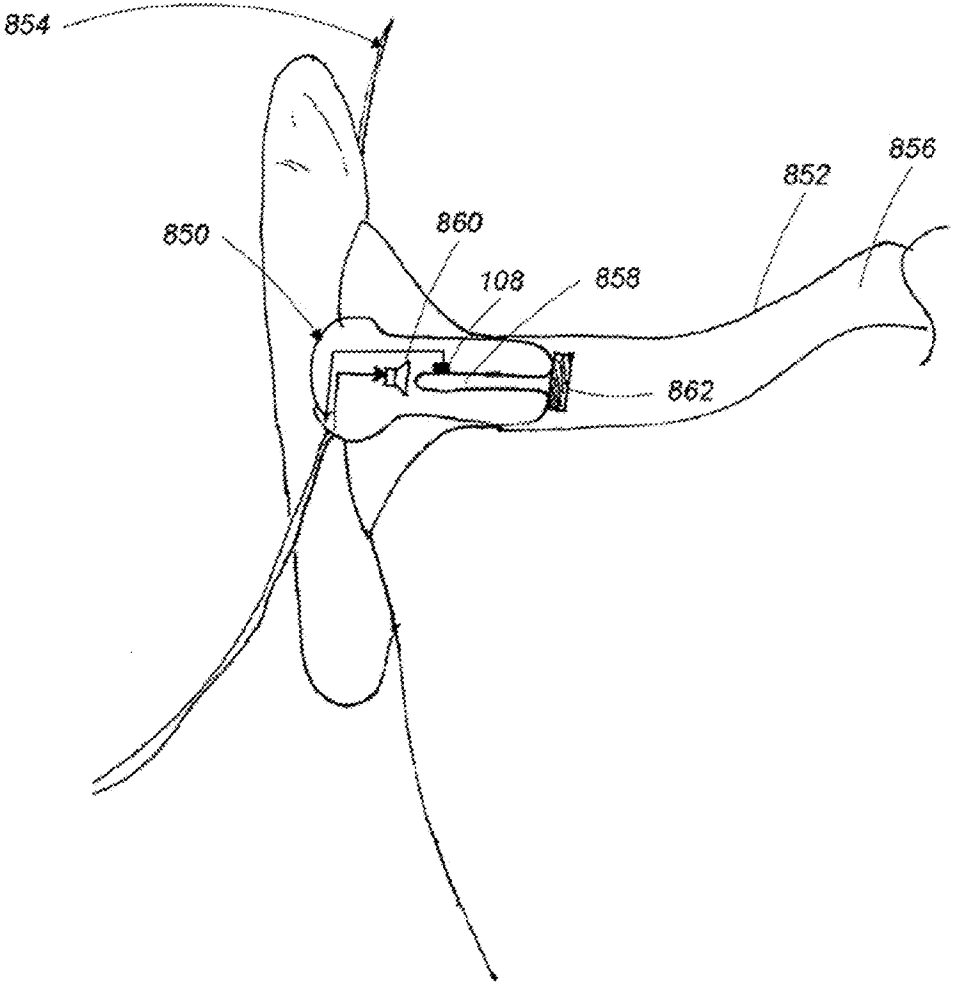
FIG. 7 is an in-ear headphone with a blocked tip.

Referring to FIG. 7, an earbud 850 of an active noise reduction headphone system is configured to be inserted into an ear canal 852 of a wearer 854. When inserted, the earbud 850 presses outward against the inner walls of the wearer's ear canal 852, creating a sealed cavity 856 within the ear canal 852. The earbud 850 includes an inner cavity 858 which extends from an acoustic driver 860 in the earbud into the sealed cavity 856 within the ear canal 852.

At the end of the inner cavity 858 of the earbud 850 opposite the acoustic driver a blockage 862 obstructs the opening of the inner cavity 858 into the cavity 856 within the ear canal 852. Such a blockage 862 commonly arises while the wearer 854 is inserting the earbud 850 into the ear canal 852 and can be referred to as a "blocked tip."

Figure 8:
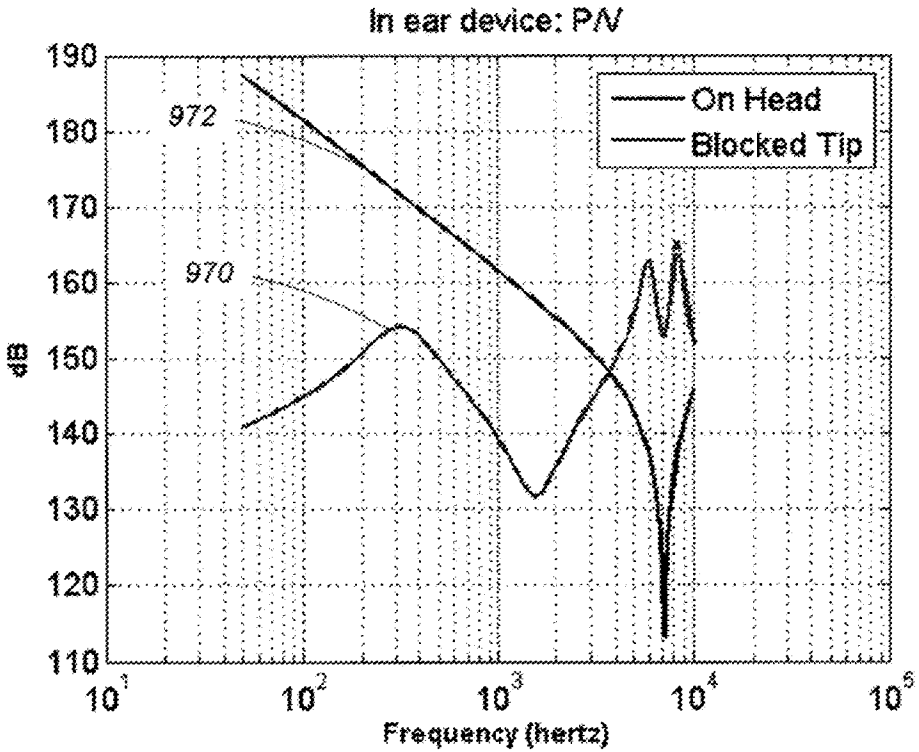
FIG. 8 is a graph of acoustic impedance for an unblocked case and a blocked case.

Referring to FIG. 8 one indication of a blocked tip is increased acoustic impedance in the inner cavity (FIG. 7, element 858) of the earbud (FIG. 7, element 850). The On-Head curve 970 in the graph shows the acoustic impedance of an earbud 850 without a blocked tip and the Blocked Tip curve 972 in the graph shows the acoustic impedance of an earbud 850 with a blocked tip. By inspection it is easily ascertained that the acoustic impedance in the blocked tip case is significantly increased.

Figure 9:
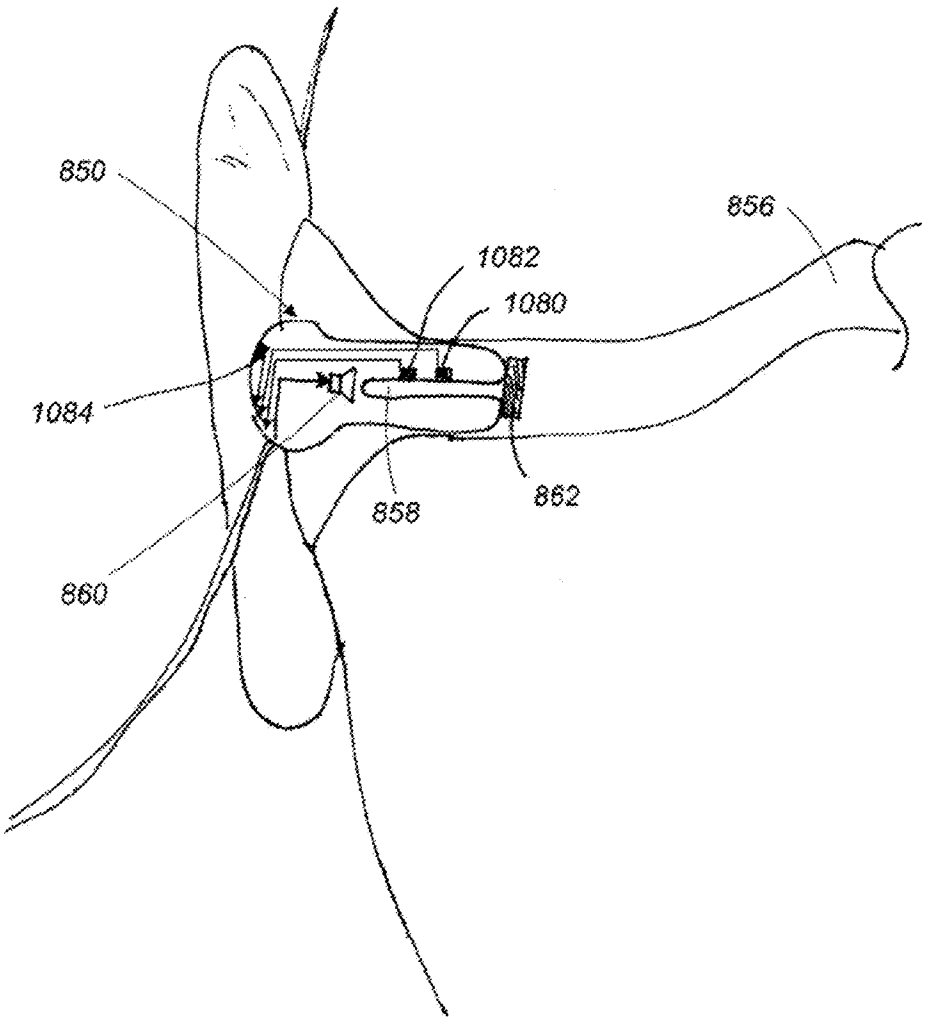
FIG. 9 is an in-ear headphone configured to detect a blocked tip.

Referring to FIG. 9, one method of detecting such a change in acoustic impedance is to use a velocity microphone 1080 in addition to the pressure microphone 1082 that is already used as the feedback microphone (FIG. 1, element 108) for the active noise reduction system (i.e., the system of FIG. 1).

The equation for acoustic impedance is:

$$z = \frac{\text{Pressure}}{\text{Velocity}}$$

Thus, acoustic impedance is determined by placing the velocity microphone 1080 in close proximity to the pressure microphone 1082 and calculating a ratio between the two microphone signals in a specified frequency range. If the acoustic impedance is determined to exceed a predetermined threshold, the tip of the earbud is likely blocked.

This method is not influenced by the nature of the sound waves emitted by the acoustic driver 860 inside the inner cavity 858 of the earbud 850 (e.g., noise, speech, audio). However, to calculate the ratio, sufficient acoustic signal must be present in the inner cavity 858 of the earbud 850.

To determine whether sufficient acoustic signal is present in the inner cavity 858 of the earbud, an additional pressure microphone 1084 can be included in the earbud 850 such that it is outside of both the inner cavity 858 of the earbud 850 and the cavity within the ear canal 856. This microphone 1084 can detect the pressure outside of the ear cavity 856 and use it to determine whether the calculated impedance is reliable. For example, the calculated impedance is considered reliable if the outside pressure exceeds a certain predetermined threshold.

5. Combined Oscillation and Blocked Tip Detector

Figure 10:
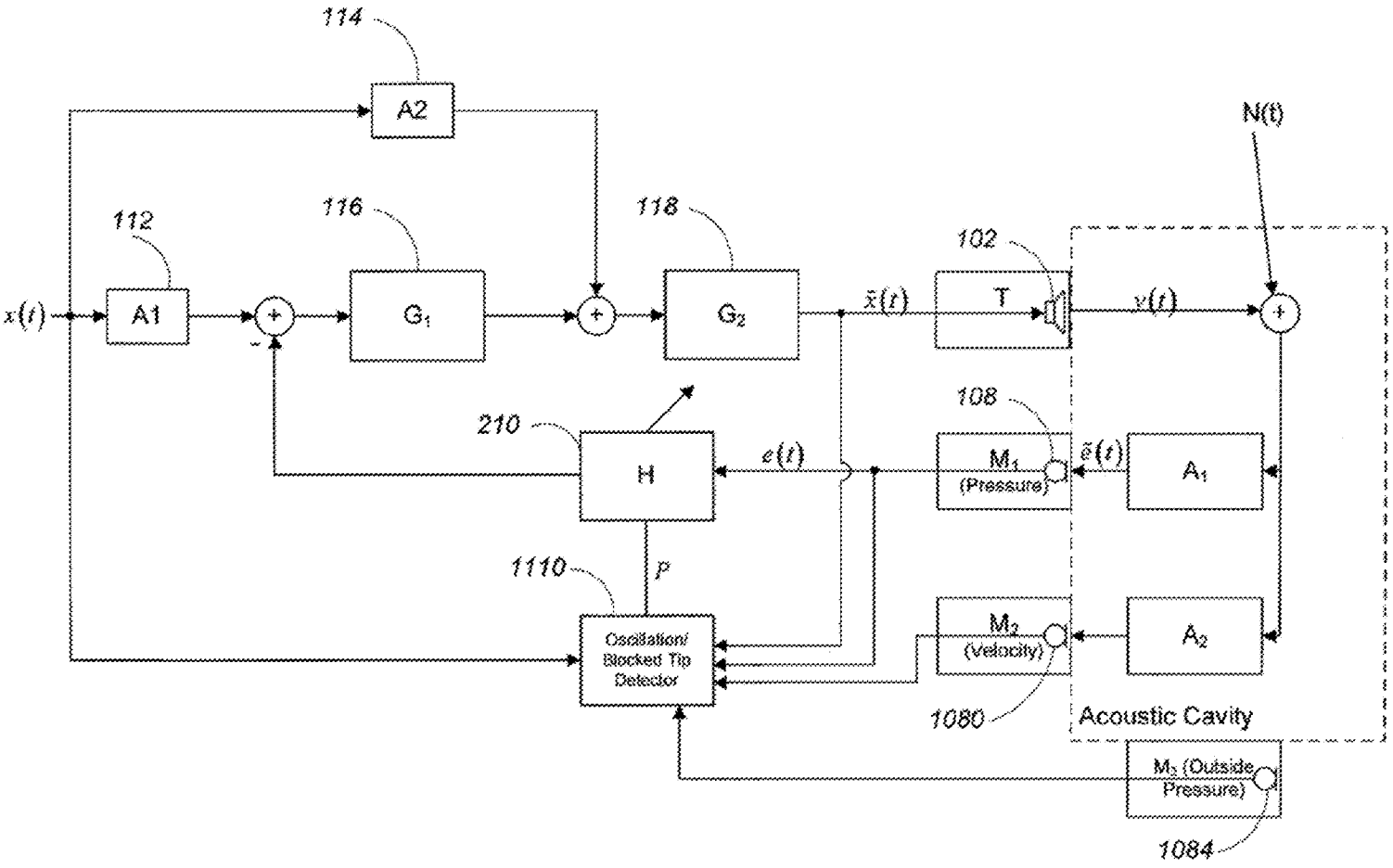
FIG. 10 is a block diagram of a feedback noise reduction including a combined oscillation/blocked tip detector.

Referring to FIG. 10, the oscillation detector 202 of the system of FIG. 1, is augmented with the blocked tip detection algorithm described above, resulting in a system 1100 which includes a combined oscillation/blocked tip detector 1110.

The basic operation of the feedback loop of the system 1100 is much the same as was described in reference to the feedback loop of the system 100 shown in FIG. 1 and therefore will not be repeated in this section.

The combined oscillation/blocked tip detector 1110 receives input from the input signal, x(t) the driver output signal $\tilde{x}(t)$, the feedback pressure microphone, M1 108, a feedback velocity microphone, M2 1080, and an outside pressure microphone, M3 1084. The output of the combined oscillation/blocked tip detector 1110 is a parameter, P which has a value of HIGH if either oscillations due to instability or a blocked tip is detected. Otherwise, P has a value of LOW. As was described above with respect to the system of FIG. 1, P is provided to the adjustable feedback factor H 210 which in turn adjusts the feedback loop gain or bandwidth to mitigate instability in the feedback loop.

Figure 11:
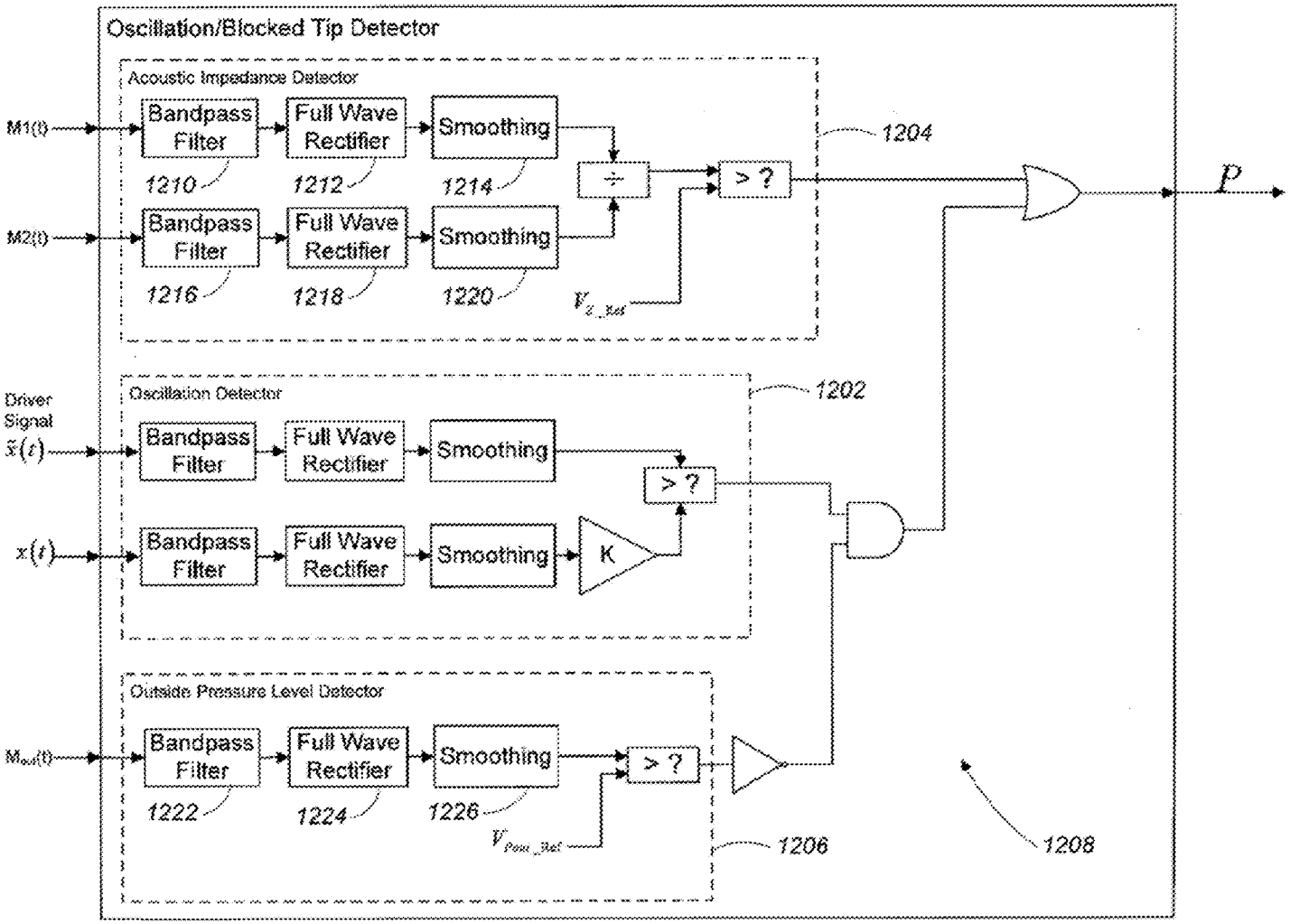
FIG. 11 is a combined oscillation/blocked tip detector.

Referring to FIG. 11, a detailed block diagram of the oscillation/blocked tip detector 1110 includes the oscillation detector 1202 described above, a blocked tip detector 1204, and an outside pressure detector 1206. The results of the oscillation detector 1202, blocked tip detector 1204, and outside pressure detector 1206 are processed using Boolean logic 1208 to produce a HIGH parameter value if an oscillation or a blocked tip is detected. Otherwise the Boolean logic 1208 produces a LOW parameter value.

The blocked tip detector 1204 receives as input the feedback pressure microphone signal M1($t$) and the velocity microphone signal M2($t$). M1($t$) is filtered by a first band-pass filter 1210, rectified by a first full wave rectifier 1212, and smoothed by a first smoothing element 1214. M2($t$) is filtered by a second band-pass filter 1216, rectified by a second full wave rectifier 1218, and smoothed by a second smoothing element 1220.

Band-pass filtering, rectification, and smoothing of the microphone input signals M1($t$) and M2($t$) results in an estimate of the signal level in a frequency of interest (e.g., a frequency where it is known that a blocked tip significantly increases acoustic impedance). The processed versions of M1($t$) is divided by the processed version of M2($t$), yielding an estimate of the acoustic impedance in the vicinity of the microphones (FIG. 10, elements 108, 1080). The estimate of the acoustic impedance is compared to an acoustic impedance threshold, $V_{Z_Ref}$. If the estimate of the acoustic impedance is greater than the reference threshold, the blocked tip detector 1204 outputs a HIGH value indicating that the tip is likely blocked. Otherwise, the blocked tip detector outputs a LOW value.

The outside pressure level detector 1206 receives as input the outside pressure microphone signal M3($t$). M3($t$) is filtered by a third band-pass filter 1222, rectified by a third full wave rectifier 1224, and smoothed by a third smoothing element 1226. The output of the third smoothing element 1226 is an estimate of the sound pressure level outside of the ear cavity. The estimate of the sound pressure level outside of the ear cavity is compared to a outside pressure threshold $V_{pout_Ref}$. If the estimate of the sound pressure level outside of the ear cavity is greater than the outside pressure threshold, the outside pressure level detector 1206 outputs a HIGH value indicating that result of the blocked tip detector 1204 is valid. Otherwise, the outside pressure level detector 1206 outputs a LOW value indicating that the result of the blocked tip detector 1204 is invalid.

The HIGH or LOW outputs of the blocked tip detector 1204, oscillation detector 1202, and the outside pressure level detector 1206 are used as input to Boolean logic 1208 which determines the output, P of the blocked tip/oscillation detector 1110.

Referring to FIG. 12, a truth table illustrates the result of applying the following Boolean logic to the outputs of the blocked tip detector 1204, oscillation detector 1202, and outside pressure level detector 1206:

$$P = \text{BlockedTipDetector} \vee (\overline{\text{OutsidePressureDetector}} \wedge \text{OscillationDetector})$$

6. Alternatives

In some examples, a microcontroller can be used to interpret the outputs of one or more of the oscillation detector, blocked tip detector, and outside pressure level detector and take action to reduce the loop gain.

In some examples, a dedicated digital signal processor or microcontroller performs the band-pass filtering, peak detection, comparator function, and gain reduction function.

Figure 13:
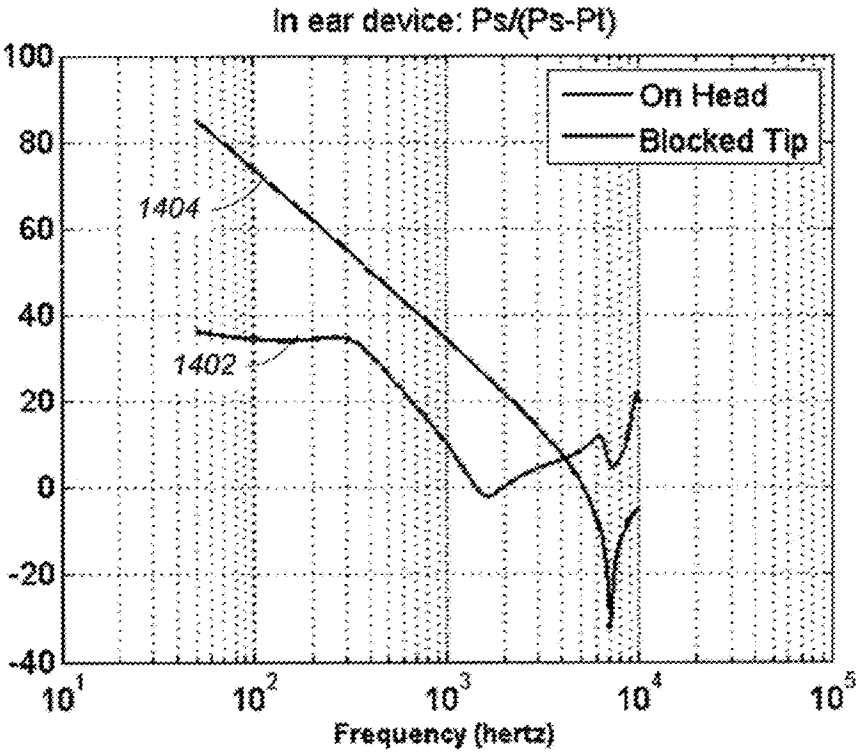
FIG. 13 is a graph of an acoustic impedance metric for an unblocked case and a blocked case.

Referring to FIG. 13, in some examples, instead of using a velocity microphone in conjunction with the feedback pressure microphone to calculate acoustic impedance, a second pressure microphone is placed inside the cavity (e.g., near the tip of the nozzle). The acoustic impedance can be calculated as the ratio P1/(P1−P2). FIG. 13 shows impedance curves calculated using this method. Curve 1402 is the impedance curve representing an unblocked tip. Curve 1404 is the impedance curve representing a blocked tip.

In some examples, a change in acoustic impedance is detected by monitoring the electrical input impedance at the driver. In some examples, due to characteristics of the driver an acoustic to electric transformation ratio is relatively small, resulting in a poor signal to noise ratio. However, characteristics of the driver can be adjusted to yield a larger acoustic to electric transformation ratio resulting in an improved signal to noise ratio.

The above description focuses on a single channel of an in-ear headphone system. However, it is noted that the system described above can be extended to two or more channels.

Just as the oscillation detector can be used to detect instability without the use of the blocked tip detector, the blocked tip detector can be used alone to detect a potential instability without the use of the oscillation detector. Neither depends on the other and each can be effectively used independently.

Although described in the context of an in-ear active noise cancellation system, the approaches described above can be applied in other situations. For example, the approaches can be applied to over-the-ear noise cancellation headphones. More generally, the approaches may be applied to other audio feedback situations, particularly when characteristics of an audio component of a feedback path may vary, for example the audio characteristics of a room or a vehicle passenger compartment may change (e.g., when a door or window is opened). Furthermore, the method of oscillation and impedance detection described above may be applied to motion control systems where feedback loop oscillation and mechanical impedance (e.g., velocity/force) can be detected and measured.

In the above description, the feedback loop gain is adjusted by modifying a feedback factor in the feedback path. In some examples, instead of adjusting the feedback loop gain in the feedback path, the forward path gain elements can be adjusted.

In some examples, the circuitry to implement the approaches described above is integrated into a housing including the drivers and microphones. In other examples, the circuitry is provided separately, and may be configurable to be suitable for different housings and arrangements of drivers and microphones.

In some examples, in active noise reduction systems which include feedback, feedforward, and audio input filtering, it is desirable to modify the filter transfer functions of all three of the filters (i.e., the audio input filter, the feedforward filter, and the feedback filter) concurrently when the instability/oscillation detector is activated. Modifying the transfer function of all three filters concurrently compensates for the entire system response due to a change in the feedback loop gain response. Such a modification of filter transfer functions can occur in both analog hardware or DSP based systems.

It is to be understood that the foregoing description is intended to illustrate and not to limit the scope of the invention, which is defined by the scope of the appended claims. Other embodiments are within the scope of the following claims.

What is claimed is:

1. A feedback based active noise reduction system comprising:

a feedback element including a first signal input for accepting an input signal, a feedback input for accepting a first feedback signal from a first sensor, a control input for accepting a control parameter for adjusting a gain characteristic and a phase characteristic of the feedback element, and a driver output for providing a driver signal to a driver; and an instability detector for detecting an instability condition including the presence of an oscillation in a specified frequency range in the feedback element and forming the control parameter based on a result of the detection, the instability detector including a second signal input for accepting the input signal, a driver input for accepting the driver signal, a control parameter output for providing the control parameter to the control parameter input of the feedback element, and a plurality of inputs for accepting a plurality of feedback signals from a plurality of sensors including the first sensor, wherein detecting the instability condition includes processing the plurality of feedback signals to determine a characteristic of an acoustic path between the driver and the first sensor, and determining a characteristic of the feedback element based on the input signal and the driver signal including analyzing the input signal and driver signal to determine whether the oscillation is present in the driver signal and that the oscillation is not present in the input signal.

2. The system of claim 1 wherein the first sensor includes a microphone and the driver includes a loudspeaker.

3. The system of claim 1 wherein the feedback element is configured to cause one or both of the gain characteristic and the phase characteristic of the feedback element to change by a predetermined amount upon providing of the control parameter.

4. The system of claim 1 wherein the feedback element is configured to concurrently modify a transfer function of a feedback filter, a feedforward filter, and an audio input filter upon providing of the control parameter.

5. The system of claim 1 wherein the feedback element is configured to cause the bandwidth of the feedback element to change by a predetermined amount upon providing of the control parameter.

6. The system of claim 1 wherein the feedback element further comprises a low-pass filter selectably applicable to the feedback element according to the control parameter.

7. The system of claim 1 wherein the plurality of sensors includes a second sensor and the instability detector is configured to determine the characteristic of the acoustic path between the driver and the first sensor based on a ratio of the first feedback signal associated with the first sensor to a second feedback signal associated with the second sensor.

8. The system of claim 7 wherein the ratio of the first feedback signal to the second feedback signal represents an acoustic impedance of the acoustic path.

9. The system of claim 7 wherein the first sensor includes a pressure microphone and the second sensor includes a velocity microphone.

10. The system of claim 7 wherein the first sensor includes a pressure microphone and the second sensor includes a pressure microphone.

11. The system of claim 7 wherein the plurality of sensors includes a third sensor for producing a third feedback signal and the instability detector is configured to determine the validity of the instability condition detected by the instability detector based on the third feedback signal.

12. The system of claim 1 wherein the specified frequency range is mutually exclusive from a frequency range where active noise reduction occurs.

13. A method for detecting and avoiding instability in a feedback based active noise reduction system, the method comprising:

accepting, at a feedback element, an input signal, detecting, using an instability detector, an instability condition including the presence of an oscillation in a specified frequency range in the feedback element and forming a control parameter based on the result of the detection, detecting the instability condition including accepting a plurality of feedback signals from a plurality of sensors including a first sensor; and processing the plurality of feedback signals to determine a characteristic of an acoustic path between the driver and the first sensor;

accepting, at the instability detector, the input signal and a driver output signal, analyzing the input signal and driver signal to determine whether the oscillation is present in the driver signal and that the oscillation is not present in the input signal; and providing the control parameter to the feedback element;

accepting, at the feedback element, the control parameter;

accepting, at the feedback element, a first feedback signal from the first sensor;

adjusting a gain characteristic and a phase characteristic of the feedback element based on the control parameter; and outputting, from the feedback element, the driver output signal to a driver.

14. The method of claim 13 wherein the first sensor includes a microphone and the driver includes a loudspeaker.

15. The method of claim 13 wherein providing the control parameter to the feedback element causes one or both of the gain characteristic and the phase characteristic of the feedback element to change by a predetermined amount.

16. The system of claim 13 wherein providing the control parameter to the feedback element causes a concurrent modification of a transfer function of a feedback filter, a feedforward filter, and an audio input filter.

17. The method of claim 13 wherein providing the control parameter to the feedback element causes the bandwidth of the feedback element to change by a predetermined amount.

18. The method of claim 13 wherein providing the control parameter to the feedback element causes a low-pass filter to be selectably applied to the feedback element based on the provided parameter.

19. The method of claim 13 wherein the plurality of sensors includes a second sensor and determining the characteristic of the acoustic path between the driver and the first sensor includes calculating a ratio of the first feedback signal associated with the first sensor to a second feedback signal associated with the second sensor.

20. The method of claim 19 wherein the ratio of the first feedback signal to the second feedback signal represents an acoustic impedance of the acoustic path.

21. The method of claim 19 wherein the first sensor includes a pressure microphone and the second sensor includes a velocity microphone.

22. The method of claim 19 wherein the first sensor includes a pressure microphone and the second sensor includes a pressure microphone.

23. The method of claim 19 wherein the plurality of sensors includes a third sensor for producing a third feedback signal and detecting the instability condition includes determining the validity of the instability condition based on the third feedback signal.

24. The method of claim 13 wherein the specified frequency range is mutually exclusive from a frequency range where active noise reduction occurs.

* * * * *